US012195907B2

(12) United States Patent
Jang et al.

(10) Patent No.: US 12,195,907 B2
(45) Date of Patent: Jan. 14, 2025

(54) LAUNDRY APPLIANCES RECOMMENDATION SYSTEMS AND METHODS

(71) Applicant: Haier US Appliance Solutions, Inc., Wilmington, DE (US)

(72) Inventors: Jongdeok Jang, Seoul (KR); Kyoung-june Yi, Yongin (KR); Myunggeon Chung, Seoul (KR); Wonshik Choi, New York, NY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 256 days.

(21) Appl. No.: 17/698,097

(22) Filed: Mar. 18, 2022

(65) Prior Publication Data

US 2023/0295857 A1 Sep. 21, 2023

(51) Int. Cl.

| | |
|---|---|
| ***D06F 34/28*** | (2020.01) |
| ***D06F 33/47*** | (2020.01) |
| ***D06F 34/05*** | (2020.01) |
| ***D06F 34/14*** | (2020.01) |

(52) U.S. Cl.

CPC ..... *D06F 34/28* (2020.02); *D06F 33/47* (2020.02); *D06F 34/05* (2020.02); *D06F 34/14* (2020.02)

(58) Field of Classification Search

CPC ..... D06F 34/28; D06F 33/47; D06F 34/05; D06F 34/14

See application file for complete search history.

(56) References Cited

U.S. PATENT DOCUMENTS

| | | | | |
|---|---|---|---|---|
| 10,443,266 | B2 | 10/2019 | Johnson et al. | |
| 2017/0081796 | A1 | 3/2017 | Velveal et al. | |
| 2020/0143305 | A1* | 5/2020 | Mund | G06Q 10/02 |
| 2021/0381152 | A1* | 12/2021 | Belveal | D06F 33/00 |
| 2022/0155739 | A1* | 5/2022 | Baazi | G05B 23/0283 |
| 2023/0068447 | A1* | 3/2023 | Campbell, III | G06F 3/0484 |

FOREIGN PATENT DOCUMENTS

JP 2019201771 A * 11/2019

* cited by examiner

*Primary Examiner* — Michael W Choi
(74) *Attorney, Agent, or Firm* — Dority & Manning, P.A.

(57) ABSTRACT

A method of operating a plurality of laundry appliances includes receiving a user input comprising one or more selected parameters for an operation cycle of a first laundry appliance and receiving a start command for the operation cycle of the first laundry appliance. The method further includes determining that the first laundry appliance is not performing the operation cycle as expected after receiving the start command for the operation cycle. The method also includes identifying one or more additional laundry appliances that are compatible with the operation cycle and providing a user notification of the one or more identified additional laundry appliances.

15 Claims, 6 Drawing Sheets

LAUNDRY APPLIANCES RECOMMENDATION SYSTEMS AND METHODS

FIELD OF THE INVENTION

The present subject matter relates generally to systems and methods for determining a first laundry appliance is not operating as intended and for identifying a second laundry appliance which may be an acceptable substitute for the first laundry appliance.

BACKGROUND OF THE INVENTION

Laundry appliances generally include washing machine appliances and dryer appliances. Such laundry appliances are typically paired, such that after washing a load of articles in the washing machine appliance of the pair, the load of articles may be easily transferred to the dryer appliance that is paired with the washing machine appliance.

In some instances, a laundry appliance, e.g., washing machine appliance or dryer appliance, may not operate as intended. For example, such laundry appliance may be a first laundry appliance, e.g., the first laundry appliance chronologically in a sequence of laundry appliances with which the user attempts to perform a wash or dry operation. In such cases, the user may become dissatisfied if he or she is unable to complete the desired wash or dry operation, such as if the user is unaware of nearby similar laundry appliances (e.g., a second laundry appliance, third laundry appliance, etc.) which may be available to complete the operation that was initiated with the first laundry appliance.

Thus, systems and methods that assist with locating a suitable second laundry appliance in instances where a first laundry appliance does not operate as intended would be beneficial.

BRIEF DESCRIPTION OF THE INVENTION

Aspects and advantages of the invention will be set forth in part in the following description, or may be obvious from the description, or may be learned through practice of the invention.

In accordance with one embodiment of the present disclosure, a method of operating a plurality of laundry appliances is provided. The method includes receiving a user input comprising one or more selected parameters for an operation cycle of a first laundry appliance and receiving a start command for the operation cycle of the first laundry appliance. The method also includes determining, by a remote computing device, that the first laundry appliance is not performing the operation cycle as expected after receiving the start command for the operation cycle. The method further includes identifying, by the remote computing device, one or more additional laundry appliances that are compatible with the operation cycle. The method also includes providing a user notification of the one or more identified additional laundry appliances via a remote user interface device.

In accordance with another embodiment of the present disclosure, a method of operating a plurality of laundry appliances is provided. The method includes receiving a user input comprising one or more selected parameters for an operation cycle of a first laundry appliance and receiving a start command for the operation cycle of the first laundry appliance. The method further includes determining that the first laundry appliance is not performing the operation cycle as expected after receiving the start command for the operation cycle. The method also includes identifying one or more additional laundry appliances that are compatible with the operation cycle and providing a user notification of the one or more identified additional laundry appliances.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
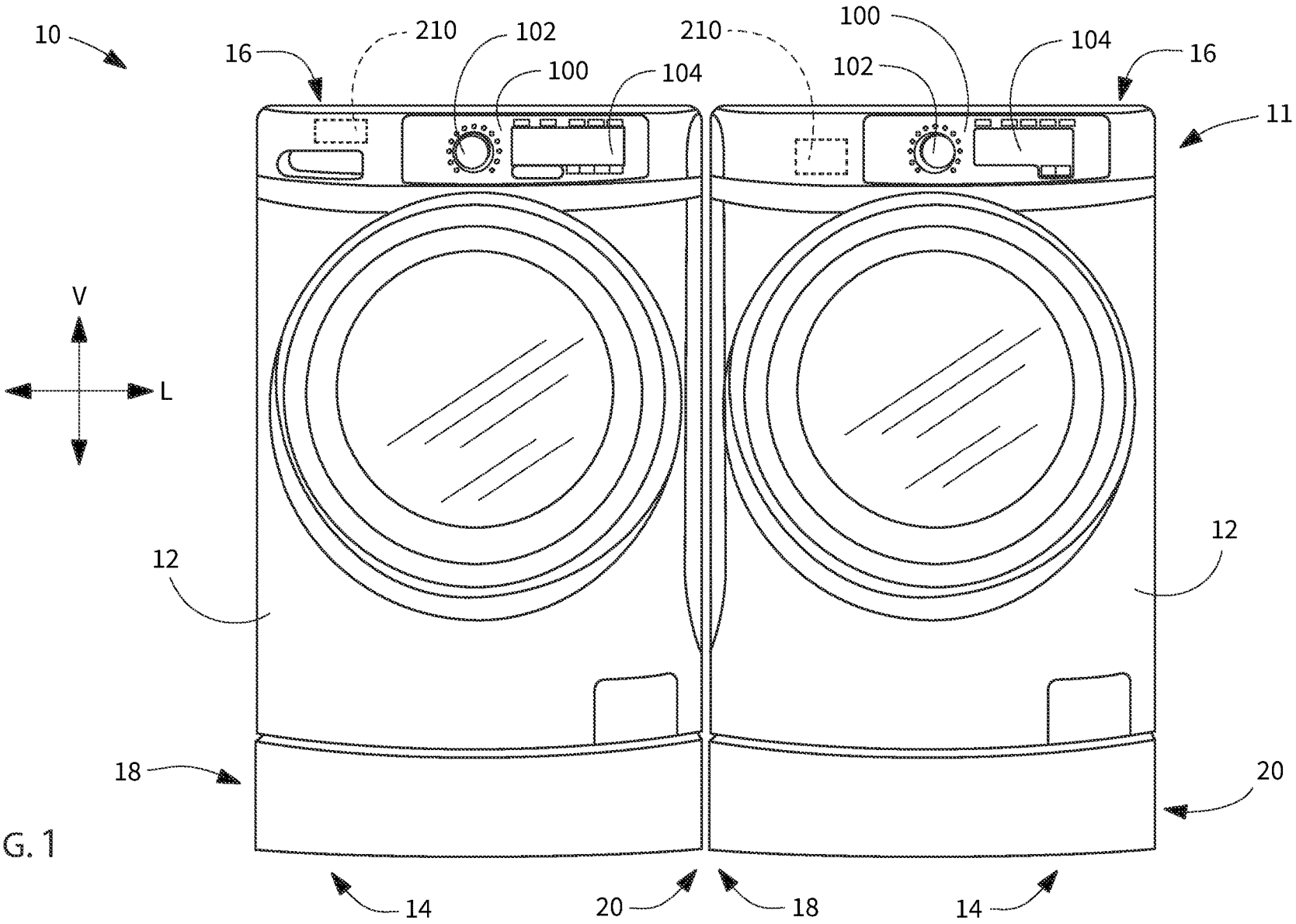
FIG. 1 provides a front view of an exemplary washing machine appliance and an exemplary dryer appliance in accordance with one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
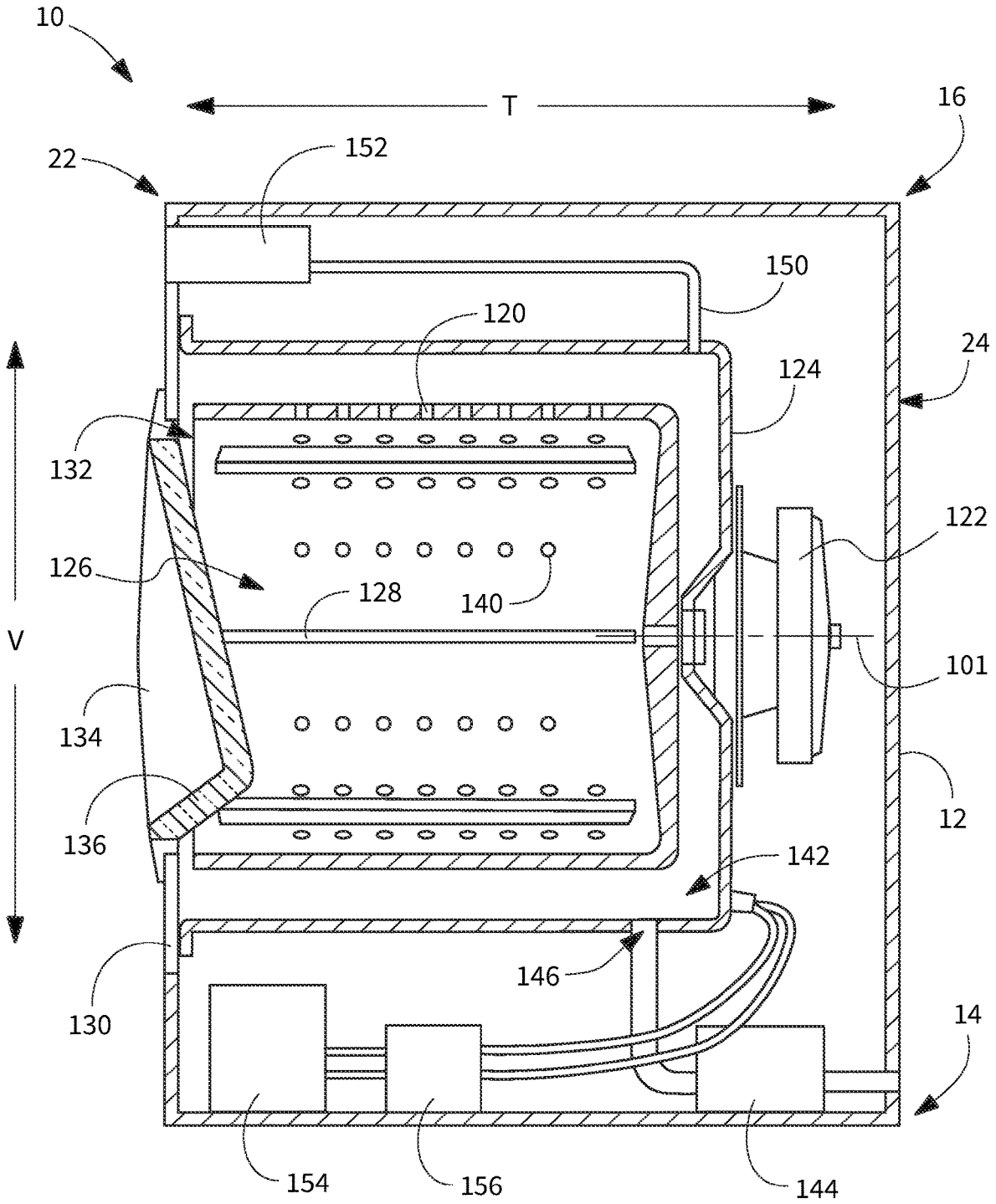
FIG. 2 provides a transverse cross-sectional view of the exemplary washing machine appliance of FIG. 1.
Figure 3:
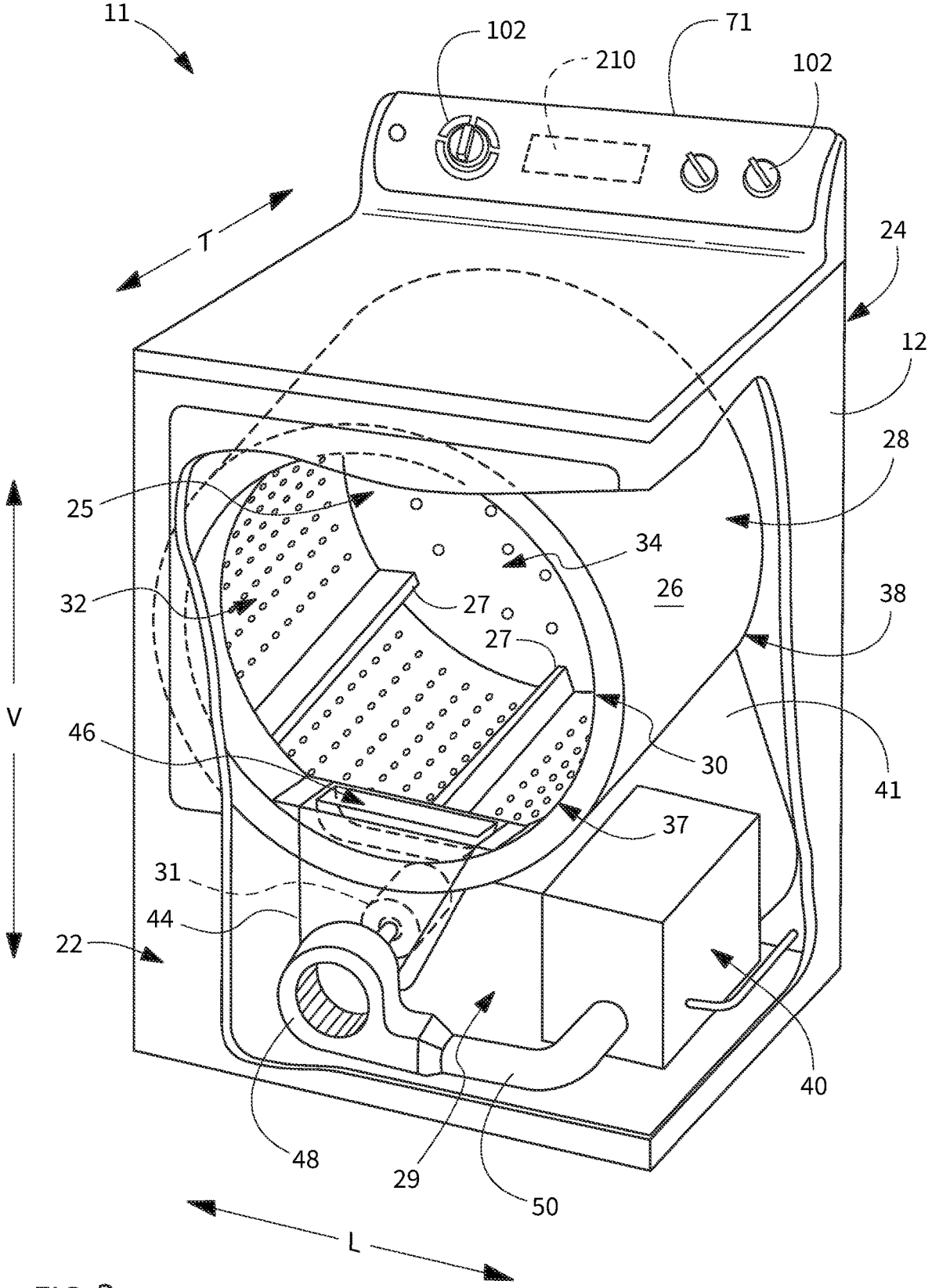
FIG. 3 provides a perspective view of the exemplary dryer appliance of FIG. 1 with portions of a cabinet of the dryer appliance removed to reveal certain components of the dryer appliance.

Exemplary laundry appliances are illustrated in FIGS. 1 through 3, e.g., a washing machine appliance and a dryer appliance. In various embodiments of the present subject matter, a laundry appliance may be any suitable laundry appliance, such as a washing machine appliance, a dryer appliance, a combination washer-dryer appliance, etc.

As may be seen generally throughout FIGS. 1 through 3, a user interface panel 100 and a user input device 102 may be positioned on an exterior of the laundry appliance. The user input device 102 is generally positioned proximate to the user interface panel 100, and in some embodiments, the user input device 102 may be positioned on the user interface panel 100.

In various embodiments, the user interface panel 100 may represent a general purpose I/O ("GPIO") device or functional block. In some embodiments, the user interface panel 100 may include or be in operative communication with user input device 102, such as one or more of a variety of digital, analog, electrical, mechanical or electro-mechanical input devices including rotary dials, control knobs, push buttons, and touch pads. The user interface panel 100 may include a display component 104, such as a digital or analog display device designed to provide operational feedback to a user. The display component 104 may also be a touchscreen capable of receiving a user input, such that the display component 104 may also be a user input device in addition to or instead of the user input device 102.

Generally, each appliance may include a controller 210 in operative communication with the user input device 102. The user interface panel 100 and the user input device 102 may be in communication with the controller 210 via, for example, one or more signal lines or shared communication busses. Input/output ("I/O") signals may be routed between controller 210 and various operational components of the appliance. Operation of the appliance can be regulated by the controller 210 that is operatively coupled to the user interface panel 100. A user interface panel 100 may for example provide selections for user manipulation of the operation of an appliance, e.g., via user input device 102 and/or display 104. In response to user manipulation of the user interface panel 100 and/or user input device 102, the controller 210 may operate various components of the appliance. Controller 210 may include a memory and one or more microprocessors, CPUs or the like, such as general or special purpose microprocessors operable to execute programming instructions or micro-control code associated with operation of the appliance. The memory may represent random access memory such as DRAM, or read only memory such as ROM or FLASH. In one embodiment, the processor executes programming instructions stored in memory. The memory may be a separate component from the processor or may be included onboard within the processor. Alternatively, a controller 210 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 210 may be programmed to operate the appliance by executing instructions stored in memory. For example, the instructions may be software or any set of instructions that when executed by the processing device, cause the processing device to perform operations. Controller 210 can include one or more processor(s) and associated memory device(s) configured to perform a variety of computer-implemented functions and/or instructions (e.g. performing the methods, steps, calculations and the like and storing relevant data as disclosed herein). It should be noted that controllers 210 as disclosed herein are capable of and may be operable to perform any methods and associated method steps as disclosed herein.

In some embodiments, for example, as illustrated in FIG. 1, a laundry appliance may be a washing machine appliance 10 or a dryer appliance 11, and a group of laundry appliances may include multiple washing machine appliances 10 or multiple dryer appliances 11. In embodiments such as illustrated in FIG. 1, the user input device 102 of each appliance 10 and 11 may be positioned on the user interface panel 100. The embodiment illustrated in FIG. 1 also includes a display 104 on the user interface panel 100 of each household appliance 10 and 11.

As generally seen throughout FIGS. 1 through 3, in at least some embodiments, each laundry appliance 10 and 11 includes a cabinet 12 which defines a vertical direction V, a lateral direction L, and a transverse direction T that are mutually perpendicular. Each cabinet 12 extends between a top side 16 and a bottom side 14 along the vertical direction V. Each cabinet 12 also extends between a left side 18 and a right side 20, e.g., along the lateral direction L, and between a front side 22 and a rear side 24 along the transverse direction T.

Additional exemplary details of each laundry appliance are illustrated in FIGS. 2 and 3. For example, FIG. 2 provides a cross-sectional view of the exemplary washing machine appliance 10. As illustrated in FIG. 2, a wash tub 124 is non-rotatably mounted within cabinet 12. As may be seen in FIG. 2, the wash tub 124 defines a central axis 101. In the example embodiment illustrated by FIG. 2, the central axis 101 may be oriented generally along or parallel to the transverse direction T of the washing machine appliance 10. Accordingly, the washing machine appliance 10 may be referred to as a horizontal axis washing machine.

Referring again to FIG. 2, a wash basket 120 is rotatably mounted within the tub 124 such that the wash basket 120 is rotatable about an axis of rotation, which generally coincides with central axis 101 of the tub 124. A motor 122, e.g., such as a pancake motor, is in mechanical communication with wash basket 120 to selectively rotate wash basket 120 (e.g., during an agitation or a rinse cycle of washing machine appliance 10). Wash basket 120 defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. The wash basket 120 and the tub 124 may collectively define at least a portion of a tub assembly for the washing machine appliance 10.

Wash basket 120 may define one or more agitator features that extend into wash chamber 126 to assist in agitation and cleaning of articles disposed within wash chamber 126 during operation of washing machine appliance 10. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 12 also includes a front panel 130 which defines an opening 132 that permits user access to wash basket 120 within wash tub 124. More specifically, washing machine appliance 10 includes a door 134 that is positioned in front of opening 132 and is rotatably mounted to front panel 130. Door 134 is rotatable such that door 134 permits selective access to opening 132 by rotating between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 10. Door 134 also includes a handle (not shown) that, e.g., a user may pull when opening and closing door 134. Further, although door 134 is illustrated as mounted to front panel 130, it should be appreciated that door 134 may be mounted to another side of cabinet 12 or any other suitable support according to alternative embodiments.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 10. For example, during operation of washing machine appliance 10, wash fluid may be urged by gravity from basket 120 to sump 142 through plurality of perforations 140. A pump assembly 144 is located beneath tub 124 for gravity assisted flow when draining tub 124, e.g., via a drain 146. Pump assembly 144 may be configured for recirculating wash fluid within wash tub 124.

A spout 150 is configured for directing a flow of fluid into wash tub 124. For example, spout 150 may be in fluid communication with a water supply (not shown) in order to direct fluid (e.g., clean water) into wash tub 124. Spout 150 may also be in fluid communication with the sump 142. For example, pump assembly 144 may direct wash fluid disposed in sump 142 to spout 150 in order to circulate wash fluid in wash tub 124.

As illustrated in FIG. 2, a detergent drawer 152 is slidably mounted within front panel 130. Detergent drawer 152 receives a wash additive (e.g., detergent, fabric softener, bleach, or any other suitable liquid or powder) and directs the fluid additive to wash chamber 124 during operation of washing machine appliance 10. According to the illustrated embodiment, detergent drawer 152 may also be fluidly coupled to spout 150 to facilitate the complete and accurate dispensing of wash additive.

Additionally, a bulk reservoir 154 is disposed within cabinet 12. Bulk reservoir 154 is also configured for receipt of fluid additive for use during operation of washing machine appliance 10. Bulk reservoir 154 is sized such that a volume of fluid additive sufficient for a plurality or multitude of wash cycles of washing machine appliance 10 (e.g., five, ten, twenty, fifty, or any other suitable number of wash cycles) may fill bulk reservoir 154. Thus, for example, a user can fill bulk reservoir 154 with fluid additive and operate washing machine appliance 10 for a plurality of wash cycles without refilling bulk reservoir 154 with fluid additive. A reservoir pump 156 is configured for selective delivery of the fluid additive from bulk reservoir 154 to wash tub 124.

During operation of washing machine appliance 10, e.g., during a wash cycle of the washing machine appliance 10, a laundry items are loaded into wash basket 120 through opening 132, and washing operation is initiated through operator manipulation of input selectors 102. Wash tub 124 is filled with water, detergent, and/or other fluid additives, e.g., via spout 150 and/or detergent drawer 152. One or more valves (not shown) can be controlled by washing machine appliance 10 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a spin cycle, basket 120 is rotated at relatively high speeds. After articles disposed in wash basket 120 are cleaned and/or washed, the user can remove the articles from wash basket 120, e.g., by opening door 134 and reaching into wash basket 120 through opening 132.

While described in the context of a specific embodiment of horizontal axis washing machine appliance 10, using the teachings disclosed herein it will be understood that horizontal axis washing machine appliance 10 is provided by way of example only. It should be appreciated that the present subject matter is not limited to any particular style, model, or configuration of washing machine appliance. Other washing machine appliances having different configurations, different appearances, and/or different features may also be utilized with the present subject matter as well, e.g., vertical axis washing machine appliances.

FIG. 3 provides a perspective view of the dryer appliance 11 of FIG. 1, which is an example embodiment of a laundry appliance, with a portion of a cabinet or housing 12 of dryer appliance 11 removed in order to show certain components of dryer appliance 11. Dryer appliance 11 generally defines a vertical direction V, a lateral direction L, and a transverse direction T, each of which is mutually perpendicular, such that an orthogonal coordinate system is defined. While described in the context of a specific embodiment of dryer appliance 11, using the teachings disclosed herein, it will be understood that dryer appliance 11 is provided by way of example only. Other dryer appliances having different appearances and different features may also be utilized with the present subject matter as well.

Cabinet 12 includes a front side 22 and a rear side 24 spaced apart from each other along the transverse direction T. Within cabinet 12, an interior volume 29 is defined. A drum or container 26 is mounted for rotation about a substantially horizontal axis within the interior volume 29. Drum 26 defines a chamber 25 for receipt of articles of clothing for tumbling and/or drying. Drum 26 extends between a front portion 37 and a back portion 38. Drum 26 also includes a back or rear wall 34, e.g., at back portion 38 of drum 26. A supply duct 41 may be mounted to rear wall 34 and receives heated air that has been heated by a heating assembly or system 40.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance 11 (e.g., clothes dryer) and may include a mixture of different or similar articles of clothing of different or similar types and kinds of fabrics, textiles, garments and linens within a particular laundering process.

A motor 31 is provided in some embodiments to rotate drum 26 about the horizontal axis, e.g., via a pulley and a belt (not pictured). Drum 26 is generally cylindrical in shape, having an outer cylindrical wall 28 and a front flange or wall 30 that defines an opening 32 of drum 26, e.g., at front portion 37 of drum 26, for loading and unloading of articles into and out of chamber 25 of drum 26. A plurality of lifters or baffles 27 are provided within chamber 25 of drum 26 to lift articles therein and then allow such articles to tumble back to a bottom of drum 26 as drum 26 rotates. Baffles 27 may be mounted to drum 26 such that baffles 27 rotate with drum 26 during operation of dryer appliance 11.

The rear wall 34 of drum 26 may be rotatably supported within the cabinet 12 by a suitable fixed bearing. Rear wall 34 can be fixed or can be rotatable. Rear wall 34 may include, for instance, a plurality of holes that receive hot air that has been heated by heating system 40. The heating system 40 may include, e.g., a heat pump, an electric heating element, and/or a gas heating element (e.g., gas burner). Moisture laden, heated air is drawn from drum 26 by an air handler, such as blower fan 48, which generates a negative air pressure within drum 26. The moisture laden heated air passes through a duct 44 enclosing screen filter 46, which traps lint particles. As the air passes from blower fan 48, it enters a duct 50 and then is passed into heating system 40. In some embodiments, the dryer appliance 11 may be a conventional dryer appliance, e.g., the heating system 40 may be or include an electric heating element, e.g., a resistive heating element, or a gas-powered heating element, e.g., a gas burner. In other embodiments, the dryer appliance may be a condensation dryer, such as a heat pump dryer. In such embodiments, heating system 40 may be or include a heat pump including a sealed refrigerant circuit. Heated air (with a lower moisture content than was received from drum 26), exits heating system 40 and returns to drum 26 by duct 41. After the clothing articles have been dried, they are removed from the drum 26 via opening 32. A door (FIG. 1) provides for closing or accessing drum 26 through opening 32.

In some embodiments, one or more selector inputs 102, such as knobs, buttons, touchscreen interfaces, etc., may be provided or mounted on the cabinet 12 (e.g., on a backsplash 71) and are in operable communication (e.g., electrically coupled or coupled through a wireless network band) with the processing device or controller 210. Controller 210 may also be provided in operable communication with components of the dryer appliance 11 including motor 31, blower 48, or heating system 40. In turn, signals generated in controller 210 direct operation of motor 31, blower 48, or heating system 40 in response to the position of inputs 102. As used herein, "processing device" or "controller" may refer to one or more microprocessors, microcontroller, ASICS, or semiconductor devices and is not restricted necessarily to a single element. The controller 210 may be programmed to operate dryer appliance 11 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controllers as disclosed herein are capable of and may be operable to perform any methods and associated method steps as disclosed herein. For example, in some embodiments, methods disclosed herein may be embodied in programming instructions stored in the memory and executed by the controller 210.

Figure 4:
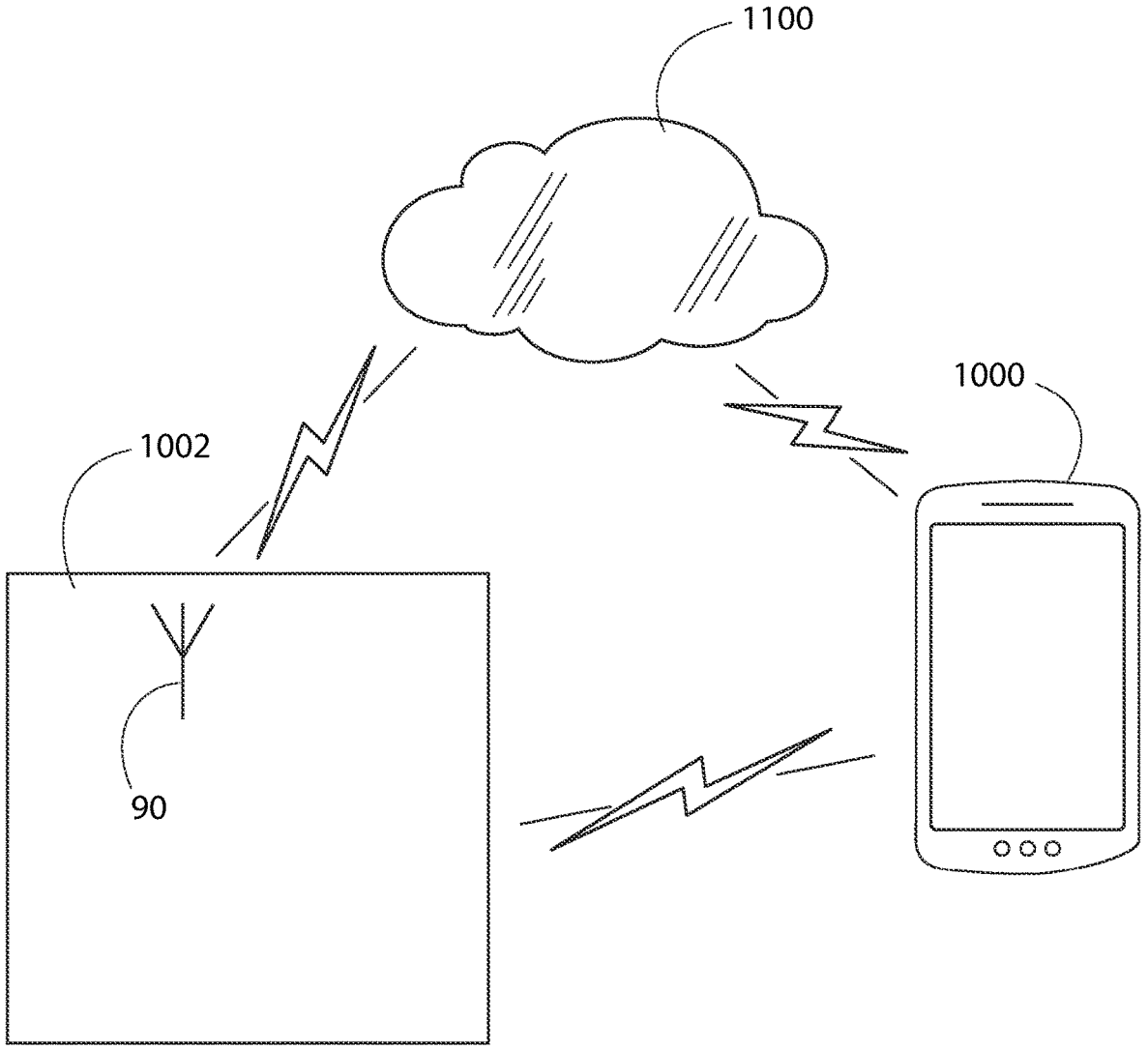
FIG. 4 provides a schematic diagram of a laundry appliance in communication with a remote user interface device and a remote computing device according to one or more embodiments of the present disclosure.

Turning now to FIG. 4, a general schematic of a laundry appliance 1002, which may be, e.g., the washing machine appliance 10 or the dryer appliance 11 described above, and communication features thereof is provided. FIG. 4 schematically illustrates a laundry appliance 1002, which may be, for example, one of the laundry appliances 10 or 11 of FIGS. 1 through 3, among other possible example laundry appliances, which communicates wirelessly with a remote user interface device 1000. For example, as illustrated in FIG. 4, the laundry appliance 1002 may include an antenna 90 by which the laundry appliance 1002 communicates with, e.g., sends and receives signals to and from, the remote user interface device 1000. The laundry appliance 1002 may communicate with the remote user interface device 1000 over a direct wireless communication link or over an indirect wireless communication link, such as via a remote server, a network, or cloud 1100. The remote user interface device 1000 may be a laptop computer, smartphone, tablet, personal computer, wearable device, smart home system, and/or various other suitable devices.

The laundry appliance 1002 may be in communication with the remote user interface device 1000 device through various possible communication connections and interfaces. The laundry appliance 1002 and the remote user interface device 1000 may be matched in wireless communication, e.g., connected to the same wireless network. The laundry appliance 1002 may communicate with the remote user interface device 1000 via short-range radio such as BLUETOOTH® or any other suitable wireless network having a layer protocol architecture. As used herein, "short-range" may include ranges less than about ten meters and up to about one hundred meters. For example, the wireless network may be adapted for short-wavelength ultra-high frequency (UHF) communications in a band between 2.4 GHz and 2.485 GHz (e.g., according to the IEEE 802.15.1 standard). In particular, BLUETOOTH® Low Energy, e.g., BLUETOOTH® Version 4.0 or higher, may advantageously provide short-range wireless communication between the appliance 10 and the remote user interface device 1000. For example, BLUETOOTH® Low Energy may advantageously minimize the power consumed by the exemplary methods and devices described herein due to the low power networking protocol of BLUETOOTH® Low Energy.

The remote user interface device 1000 is "remote" at least in that it is spaced apart from and not physically connected to the laundry appliance 1002, e.g., the remote user interface device 1000 is a separate, stand-alone device from the laundry appliance 1002 which communicates with the laundry appliance 1002 wirelessly. Any suitable device separate from the laundry appliance 1002 that is configured to provide and/or receive communications, information, data, or commands from a user may serve as the remote user interface device 1000, such as a smartphone (e.g., as illustrated in FIG. 4), smart watch, personal computer, smart home system, or other similar device. For example, the remote user interface device 1000 may be a smartphone operable to store and run applications, also known as "apps," and some or all of the method steps disclosed herein may be performed by a smartphone app.

The remote user interface device 1000 may include a memory for storing and retrieving programming instructions. Thus, the remote user interface device 1000 may provide a remote user interface which may be an additional user interface to the user interface panel 100. For example, the remote user interface device 1000 may be a smartphone operable to store and run applications, also known as "apps," and the remote user interface may be provided as a smartphone app.

As mentioned above, the laundry appliance 1002 may also be configured to communicate wirelessly with the cloud 1100, e.g., one or more remote computing devices, such as a remote database, remote server, etc., in a distributed computing environment. For example, the cloud 1100 may be or include a remote database which may be, e.g., a cloud-based data storage system. For example, the laundry appliance 1002 may communicate with the cloud 1100 over the Internet, which the laundry appliance 1002 may access via WI-FI®, such as from a WI-FI® access point in a user's home.

The remote user interface device 1000 may include a memory for storing and retrieving programming instructions. Thus, the remote user interface device 1000 may provide a remote user interface which may be an additional user interface to the user interface panel 100. For example, the remote user interface device 1000 may be a smartphone operable to store and run applications, also known as "apps," and the remote user interface may be provided as a smartphone app.

In some embodiments, the performance of exemplary methods and associated method steps as disclosed herein may be distributed, e.g., performed in part by the controller 210 and in part by one or more remote computing devices in the cloud 1100 and/or remote user interface device 1000.

Figure 5:
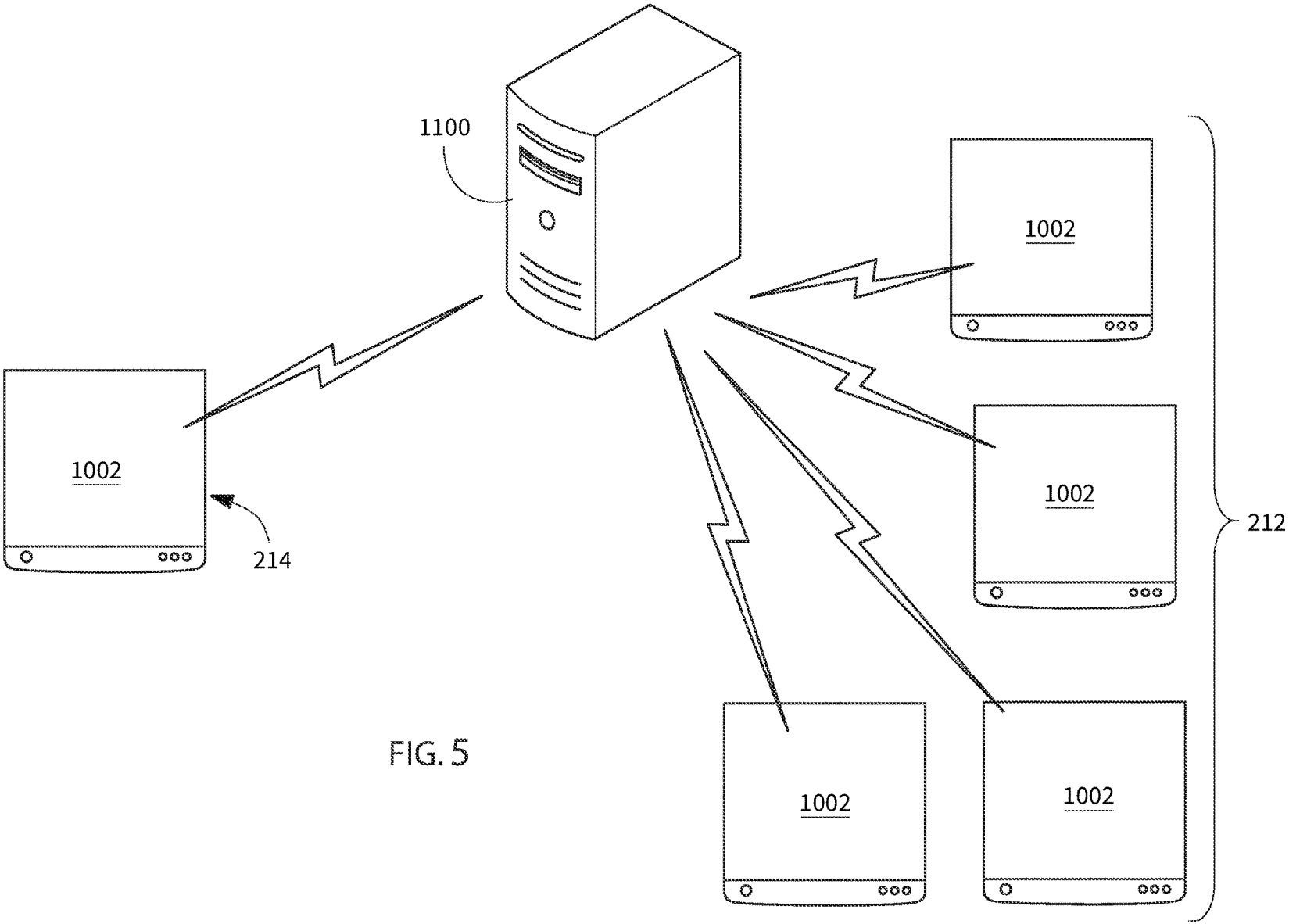
FIG. 5 provides a schematic diagram of a first laundry appliance and multiple additional laundry appliances in communication with a remote computing device.

FIG. 5 schematically illustrates a first laundry appliance 214 and a group of additional laundry appliances 212, where each appliance 1002, e.g., first laundry appliance 214 and each appliance 1002 of the group of additional laundry appliances 212 is in communication with the cloud 1100, e.g., a remote server, as described above, where the remote server 1100 illustrated in FIG. 5 is an example of a cloud computing system and/or a portion of such system according to various embodiments of the present disclosure. It should be noted that the first laundry appliance 214 is a single laundry appliance 1002 and is generally similar to the additional laundry appliances 1002, hence, each laundry appliance 1002 is individually identified by reference number 1002 in FIG. 5 regardless of whether the laundry appliance 1002 is the first laundry appliance 214 or is a member of the group of additional laundry appliances 212. The exemplary groups 212 and 214 of FIG. 5 are mutually exclusive, e.g., each laundry appliance 1002 is either the first laundry appliance 214 or belongs to the group of laundry appliances 212, but not both. As will be described in more detail below, the first laundry appliance 214 may be a laundry appliance 1002 with which a user begins or attempts to begin a laundry cycle (e.g., wash cycle or dry cycle, depending on which type of laundry appliance the particular first laundry appliance 1002 is), and the group of additional laundry appliances 212 may be one or more similar laundry appliances 1002 (i.e., similar to the first laundry appliance 214) that is or are compatible with the first laundry appliance 214 and/or a user-selected cycle thereof, such that the cycle that was attempted with the first laundry appliance 214 may be performed or completed with a second laundry appliance that is the additional laundry appliance 212 or one of the group of additional laundry appliances 212. For example, when the first laundry appliance 214 cannot perform or complete the desired operation, the user may be notified of the availability of one or more additional laundry appliances 212 and, when the user selects one additional laundry appliance (e.g., the one additional laundry appliance 212 or one of a group of additional laundry appliances 212), the selected additional, e.g., second, laundry appliance 1002 may then be automatically, such as remotely, reserved for the user. The second laundry appliance 1002 may also be setup for the user, e.g., by importing user-selected operation parameters from the first laundry appliance 214 to the selected additional laundry appliance 212, such as via the cloud 1100 (e.g., a remote server 1100 in the cloud). Additionally, the user may be given credit for the cost of operating the additional laundry appliance 212, such as a refund or discount on the laundromat fee.

In some embodiments, the first laundry appliance 214 may be a home or domestic laundry appliance 1002, e.g., a laundry appliance 1002 located in a user's residence, while the additional laundry appliance 212 are commercial laundry appliances 1002, e.g., located in a laundromat. In additional embodiments, all of the laundry appliances 1002 may be commercial laundry appliances 1002, e.g., the first laundry appliance 214 may be located in a laundromat and the second or other additional laundry appliances 212 may also be located in a laundromat, e.g., the same laundromat as the first laundry appliance 214.

Figure 6:
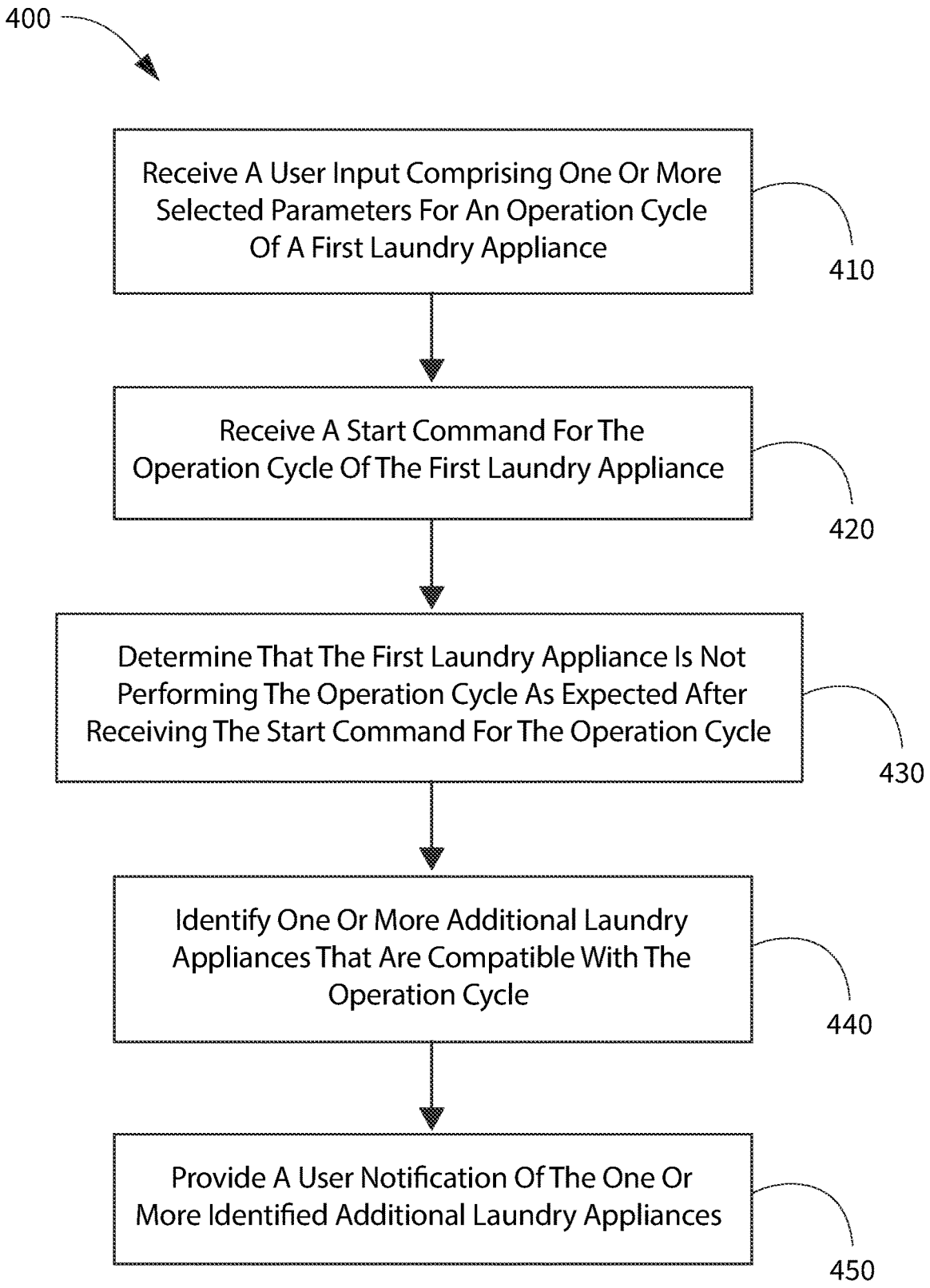
FIG. 6 provides a flowchart illustrating an example method of operating a group of laundry appliances according to one or more embodiments of the present disclosure.

As illustrated in FIG. 6, embodiments of the present disclosure also include methods of operating a plurality of laundry appliances, e.g., a plurality of one type of laundry appliances described above, such as a plurality of washing machine appliances 10 or a plurality of dryer appliances 11, among other possible exemplary laundry appliances. Exemplary methods according to the present subject matter include the method 400 illustrated in FIG. 6. Methods such as method 400 can be used to operate any suitable laundry appliance. For example, such methods may be utilized to operate a plurality of washing machine appliances 10 or a plurality of dryer appliances 11 (FIGS. 1 through 3). Controller 210 of laundry appliance 10 or 11 may be programmed to implement method 400, e.g., controller 210 is capable of and may be operable to perform any methods and associated method steps as disclosed herein. In some embodiments, the controller 210 may perform method steps in combination with one or more remote computing devices, such as a remote database or remote processor or one or more other remote computing devices, e.g., in the cloud. In such embodiments, the controller 210 may communicate with such remote computing device or devices via the internet, among other possible communications means. For example, some embodiments of the methods disclosed herein may include distributed computing whereby certain steps or calculations/determinations are performed locally, e.g., by the controller 210 onboard the laundry appliance 10 or 11, while other steps or calculations/determinations are performed by a remote computing device with which the controller 210 communicates via the internet.

As illustrated in FIG. 6, the method 400 may include a step 410 of receiving a user input comprising one or more selected parameters for an operation cycle of a first laundry appliance. As mentioned, the first laundry appliance may be any laundry appliance, such as a washing machine appliance, a dryer appliance, or a combination washer-dryer appliance, among other possible exemplary laundry appliances. The selected parameters may include, for example where the laundry appliance in a washing machine appliance, a fabric type, spin speed, water temperature, and/or other similar wash cycle parameters. In additional embodiments, e.g., where the laundry appliance is a dryer appliance, the selected parameters may include a heat level, a cycle time, a desired dryness level, and/or other similar dry cycle parameters. Further, where the laundry appliance is a combination appliance, any of the foregoing example parameters may be selected. The user input may be received locally, e.g., by a user interface such as user interface panel 100 onboard the laundry appliance, or remotely, such as from an app on a remote user interface device.

Method 400 may further include a step 420 of receiving a start command for the operation cycle of the first laundry appliance. Similar to the selected parameters, the start command may be received locally or remotely, including combinations thereof, such as the parameter selections received remotely and the start command received locally. After receiving the start command at step 420, method 400 may include a step 430 of determining that the first laundry appliance is not performing the operation cycle as expected. For example, step 430 may be performed by a remote computing device, e.g., in the cloud. As will be described further below, in some cases, the first laundry appliance may fail to perform as expected during the operation cycle, while in other cases the first laundry appliance may fail to perform as expected by not performing the operation cycle at all, e.g., the first laundry appliance may be inoperative.

In some embodiments, the determination that the first laundry appliance is not performing the operation cycle as expected may be based on fault codes generated by the first laundry appliance. For example, in some embodiments, step 430 may include receiving one or more fault codes. Such fault codes may, for example, be received by the remote computing device, e.g., in the cloud, from the first laundry appliance. In order to determine whether the fault codes actually indicate a failure to operate as expected, the method may further include filtering the received fault codes by the remote computing device to determine that the first laundry appliance is not performing the operation cycle as expected. For example, some fault codes may not be relevant to the core functionality of the laundry appliance, and such codes may be filtered out such that a determination that the first laundry appliance is not operating as expected and the subsequent location and identification of an alternative compatible laundry appliance is not triggered by such fault codes.

Method 400 may further include a step 440 of identifying one or more additional laundry appliances that are compatible with the operation cycle. For example, the first laundry appliance may be in communication with a remote computing device, as mentioned above, and the one or more additional laundry appliances may also be in communication with the remote computing device, e.g., a remote server as illustrated in FIG. 5, or more generally a cloud network or other distributed computing environment. Thus, the identification of the one or more additional laundry appliances may be performed by the remote computing device, such as by comparing features sets, e.g., available options, cycles, etc., of the first laundry appliance and the one or more additional laundry appliances to determine or identify compatible laundry appliances based on the selected operation cycle and/or selected parameters thereof. For example, the features sets and locations of each laundry appliance may be stored in a remote database and compared by the remote database or another remote computing device in operative communication with the remote database. Accordingly, the one or more additional laundry appliances may be identified as compatible with the operation cycle based on the similarity of their feature sets and/or available options to the user-selected parameters and/or the operation cycle.

Still referring to FIG. 6, method 400 may further include a step 450 of providing a user notification of the one or more identified additional laundry appliances. For example, the user notification may be provided via a remote user interface device, such as by an email, a text (e.g., SMS) message, a notification in an app on a smartphone or tablet, an audible notification from a smart home system or smart speaker, or one or more other similar notifications, including combinations thereof.

In some embodiments, multiple user notifications may be provided, including provided to multiple users. For example, in some embodiments where the first laundry appliance is a commercial laundry appliance, e.g., in a laundromat, the method may further include sending an owner notification to an owner of the commercial laundry appliance, e.g., an owner or operator of the laundromat, in addition to the user.

The user notification of step 450 may take the form of a list of the one or more additional laundry appliances. For example, the list may be a ranked list. In some embodiments, the list may be ranked by similarity of feature sets to the features of the first laundry appliance, such as the selected operation cycle of step 410 and/or one or more favorite or frequently-used cycles of the first laundry appliance associated with a user profile in a remote computing device, e.g., in the cloud. In some embodiments, the step of identifying the one or more additional laundry appliances may include comparing available operation cycles on the one or more additional laundry appliances with stored operation cycle selections for the first laundry appliance stored in a user profile on the remote computing device, and ranking the one or more additional laundry appliances based on similarity of the available operation cycles to the stored operation cycle selections. For example, such comparing and ranking steps may be performed in the cloud, e.g., by one or more remote computing devices. In particular embodiments where the first laundry appliance is a domestic laundry appliance, the one or more additional laundry appliances may be commercial laundry appliances, and the ranked list of the one or more identified additional laundry appliances may be ranked by proximity, e.g., proximity to the user's residence. A domestic appliance includes, e.g., an appliance that is privately owned and/or located in a residence and is used by a single user or discrete group of users, such as a family or group of roommates, where the owner and user are generally the same person (or the owner is a member of the discrete group of users). For example, the ranked list may include closest proximity and most similar feature sets first, or most similar feature sets first, followed by a list of the remaining identified additional laundry appliances ranked by proximity, or other such combinations of ranking factors and/or orders. In one particular example, where the laundry appliances are washing machine appliances, the operation cycle may be a delicates cycle and/or the selected parameters may include a fabric type selection such as silks, and/or the silk cycle or delicates cycle may be a frequently-selected cycle, e.g., in a user profile stored in the cloud. In this example, the ranked list may include laundry appliances having a silk cycle feature at or near the top of the ranked list. In some embodiments, the laundry appliances having a silk cycle feature may be highlighted in the ranked list, such as starred and placed at the top of the ranked list, for example. In embodiments where the first laundry appliance is a commercial laundry appliance, e.g., in a laundromat, the identified additional laundry appliances may all be in a common location or same location, e.g., same laundromat, as the first laundry appliance, such that the ranked list may not be ranked by proximity and only ranked by similarity of features, e.g., when the additional laundry appliances are all in the same location.

In some embodiments, method 400 may further include receiving a user selection of one of the identified additional laundry appliances, or of the one additional laundry appliance when only one additional laundry appliance is identified, e.g., at step 450. Thus, the selected one additional laundry appliance may also be referred to as a second laundry appliance. For example, the operation cycle may be initiated or attempted to initiate by the first laundry appliance and then, after determining that the first laundry appliance is not performing the operation cycle as expected, the operation cycle may be continued, e.g., completed, by the second laundry appliance. In some embodiments, e.g., depending on the particular cycle or portion of the cycle during which it was determined that the first laundry appliance was not performing as expected, the operation cycle may be restarted at the second laundry appliance. For example, when the laundry appliances are washing machine appliances, and the first laundry appliance is not performing as expected during a fill cycle or rinse cycle, the cycle may start over at the second laundry appliance and then may measure the required amount of water in the second laundry appliance, e.g., during a new fill or rinse cycle in the second laundry appliance. The user selection of the one of the identified additional laundry appliances may be received by the remote user interface device. The remote user interface device may transmit the user selection to the cloud, and further selections or other interactions with the second laundry appliance may be performed by or transferred through the cloud. Such embodiments may further include one or more additional steps for completing the operation cycle with the selected additional laundry appliance and/or transferring the operation cycle to the selected additional laundry appliance. For example, in some embodiments, method 400 may further include transmitting the one or more selected parameters for the operation cycle to the selected one of the identified additional laundry appliances. The one or more selected parameters may be transmitted, for example, by the remote computing device to the selected additional laundry appliance. In some embodiments, a cycle time may be transmitted to the selected additional laundry appliance. For example, the cycle time may be one of the user-selected parameters, or the cycle time may be a predetermined cycle time, such as a predetermined cycle time associated with a user-selected cycle. Also by way of example, the cycle time may be extended in some embodiments. For example, where the laundry appliances are washing machine appliances and the operation cycle includes a spin cycle, if the spin cycle is started but not completed by the first laundry appliance, the remaining time in the spin cycle may be transmitted to the selected additional laundry appliance and may be extended, e.g., to include a load balancing time, a ramp-up (acceleration) time, and/or a plastering time as well as the remaining spin time from the spin cycle in the first laundry appliance. As another example, where the laundry appliances are dryer appliances, the remaining cycle time after the point at which it was determined that the first laundry appliance was not performing the operation cycle as expected may be transmitted to the selected additional laundry appliance and, in some embodiments, may be extended by a preheat time, e.g., to permit the selected additional laundry appliance to heat up to the desired temperature for the cycle. Thus, in some embodiments, the method may include determining a remaining time for at least one phase of the operation cycle and transmitting the remaining time to the selected one of the identified additional laundry appliances. For example, the remaining time for at least one phase may be the remaining time for a spin phase in a washing machine appliance or the remaining time for a heating phase in a dryer appliance, as described above. The remaining time may be determined, for example, by the first laundry appliance, such as the first laundry appliance may track the time of the operation cycle and/or various phases thereof, and pause such tracking when the failure is detected. The remaining time may be transmitted to the cloud from the first laundry appliance and then transmitted by the cloud, e.g., remote computing device, to the second laundry appliance.

In some embodiments, completing or transferring the operation cycle may include reserving the selected additional laundry appliance for the user. Thus, the user may be assured of having the selected laundry appliance available, e.g., particularly when the first laundry appliance is not located at the same location as the second laundry appliance. For example, the second laundry appliance may be reserved for the user to ensure availability of the second laundry appliance when the user arrives at the laundromat after attempting to wash and/or dry the laundry at home with the first laundry appliance. For example, the reserved laundry appliance may be unlocked via a remote user interface device, such as a smartphone, as described above. In some embodiments, the remote user interface device and the reserved laundry appliance may both be in communication with a remote server or other distributed computing system, e.g., cloud, as mentioned above, and the unlocking step may include receiving identifying information of the laundry appliance with the remote user interface device, transmitting the identifying information to the remote database from the remote user interface device, and unlocking the laundry appliance by the remote database after receiving the identifying information of the laundry appliance. For example, identifying information of the laundry appliance may be encoded in a bar code, such as a QR code. As a further example, the identifying information may include a serial number of the laundry appliance, e.g., which may be recognized in a captured image of the laundry appliance by the remote user interface device. Thus, unlocking the laundry appliance may include scanning a code on the laundry appliance or taking a picture of the laundry appliance, such as a picture of a nameplate on the laundry appliance.

In some embodiments, the method may also include providing a user prompt, such as on the remote user interface device, prior to transmitting the one or more selected parameters for the operation cycle to the selected one of the identified additional laundry appliances. For example, the user prompt may include asking whether the user would like to resume the operation cycle from the time at which it was determined that the first laundry appliance was not performing the operation cycle as expected, and/or asking whether the user would like to start a cycle with the same settings as the failed cycle, e.g., the one or more selected parameters of step 410. In such embodiments, the step of transmitting the one or more selected parameters for the operation cycle to the selected one of the identified additional laundry appliances may be performed in response to a received affirmative response to the user prompt. The response to the user prompt may be received by, e.g., the remote user interface device.

Exemplary methods according to the present disclosure may detect a failure at various points during the operation cycle, including when the operation cycle does not start at all, as well as when the operation cycle starts with the first laundry appliance but the first laundry appliance does not or can not complete the operation cycle. For example, in some embodiments, the method may include initiating the operation cycle with the first laundry appliance prior to determining that the first laundry appliance is not performing the operation cycle as expected. As another example, in additional embodiments, determining that the first laundry appliance is not performing the operation cycle as expected may include determining that the first laundry appliance is not operational, e.g., that the first laundry appliance failed to start the operation cycle. In such embodiments, the method may further include transmitting a full time duration for the operation cycle to the selected one of the identified additional laundry appliances.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a plurality of laundry appliances, the method comprising:

receiving a user input comprising one or more selected parameters for an operation cycle of a first laundry appliance;

receiving a start command for the operation cycle of the first laundry appliance;

initiating the operation cycle with the first laundry appliance in response to the start command, wherein initiating the operation cycle comprises operating at least one mechanical component of the laundry appliance;

determining, by a remote computing device, that the first laundry appliance is not performing the operation cycle as expected based on performance of at least one mechanical component of the laundry appliance operated during the operation cycle, after receiving the start command for the operation cycle and initiating the operation cycle with the first laundry appliance;

determining, by the first laundry appliance, a remaining time for at least one phase of the operation cycle;

identifying, by the remote computing device, one or more additional laundry appliances that are compatible with the operation cycle;

providing a user notification of the one or more identified additional laundry appliances via a remote user interface device;

receiving, from the remote user interface device, a selection of one of the identified additional laundry appliances;

transmitting, by the remote computing device, the remaining time to the selected one of the identified additional laundry appliances; and operating the selected one of the identified additional laundry appliances for the remaining time, wherein operating the selected one of the identified additional laundry appliances comprises operating at least one mechanical component of the selected one of the identified additional laundry appliances.

2. The method of claim 1, wherein determining that the first laundry appliance is not performing the operation cycle as expected comprises receiving one or more fault codes by the remote computing device from the first laundry appliance and filtering the received fault codes by the remote computing to determine that the first laundry appliance is not performing the operation cycle as expected.

3. The method of claim 1, further comprising transmitting, by the remote computing device, the one or more selected parameters for the operation cycle to the selected one of the identified additional laundry appliances, wherein the selected one of the identified additional laundry appliances is operated according to the one or more selected parameters.

4. The method of claim 3, further comprising providing a user prompt on the remote user interface device prior to transmitting, by the remote computing device, the one or more selected parameters for the operation cycle to the selected one of the identified additional laundry appliances, wherein the step of transmitting, by the remote computing device, the one or more selected parameters for the operation cycle to the selected one of the identified additional laundry appliances is performed in response to a received affirmative response to the user prompt received by the remote user interface device.

5. The method of claim 1, wherein the user notification of the one or more identified additional laundry appliances comprises a ranked list of the one or more identified additional laundry appliances.

6. The method of claim 5, wherein the step of identifying the one or more additional laundry appliances comprises comparing, by the remote computing device, available operation cycles on the one or more additional laundry appliances with stored operation cycle selections for the first laundry appliance stored in a user profile on the remote computing device, and ranking, by the remote computing device, the one or more additional laundry appliances based on similarity of the available operation cycles to the stored operation cycle selections.

7. The method of claim 5, wherein the first laundry appliance is a domestic laundry appliance, wherein the one or more additional laundry appliances are commercial laundry appliances, and wherein the ranked list of the one or more identified additional laundry appliances is ranked by proximity.

8. The method of claim 1, wherein the first laundry appliance is a commercial laundry appliance, the method further comprising sending an owner notification to an owner of the commercial laundry appliance.

9. The method of claim 1, wherein the first laundry appliance is a commercial laundry appliance, and wherein the one or more additional laundry appliances are in a common location with the first laundry appliance.

10. A method of operating a plurality of laundry appliances, the method comprising:

receiving a user input comprising one or more selected parameters for an operation cycle of a first laundry appliance;

receiving a start command for the operation cycle of the first laundry appliance;

initiating the operation cycle with the first laundry appliance in response to the start command, wherein initiating the operation cycle comprises operating at least one mechanical component of the laundry appliance;

determining that the first laundry appliance is not performing the operation cycle as expected based on performance of at least one mechanical component of the laundry appliance operated during the operation cycle, after receiving the start command for the operation cycle and initiating the operation cycle with the first laundry appliance;

identifying one or more additional laundry appliances that are compatible with the operation cycle, wherein identifying the one or more additional laundry appliances comprises comparing available operation cycles on the one or more additional laundry appliances with stored operation cycle selections for the first laundry appliance in a user profile, and ranking the one or more additional laundry appliances based on similarity of the available operation cycles to the stored operation cycle selections;

providing a user notification of the one or more identified additional laundry appliances via a remote user interface device, wherein the user notification of the one or more identified additional laundry appliances comprises a ranked list of the one or more identified additional laundry appliances based on similarity of the available operation cycles to the stored operation cycle selections;

receiving, from the remote user interface device, a user selection of one of the identified additional laundry appliances;;

reserving the selected one of the identified additional laundry appliances in response to the user selection; and unlocking the selected one of the identified additional laundry appliances via the remote user interface device.

11. The method of claim 10, further comprising transmitting the one or more selected parameters for the operation cycle to the selected one of the identified additional laundry appliances, wherein the selected one of the identified additional laundry appliances is operated according to the one or more selected parameters.

12. The method of claim 11, further comprising providing a user prompt prior to transmitting the one or more selected parameters for the operation cycle to the selected one of the identified additional laundry appliances, wherein the step of transmitting the one or more selected parameters for the operation cycle to the selected one of the identified additional laundry appliances is performed in response to a received affirmative response to the user prompt.

13. The method of claim 10, wherein the first laundry appliance is a domestic laundry appliances, wherein the one or more additional laundry appliances are commercial laundry appliances, and wherein the ranked list of the one or more identified additional laundry appliances is further ranked by proximity.

14. The method of claim 10, wherein the first laundry appliance is a commercial laundry appliance, the method further comprising sending an owner notification to an owner of the commercial laundry appliance.

15. The method of claim 10, wherein the first laundry appliance is a commercial laundry appliance, and wherein the one or more additional laundry appliances are in a common location with the first laundry appliance.

* * * * *